US006039148A

United States Patent [19]

Riegel

[11] Patent Number: 6,039,148

[45] Date of Patent: Mar. 21, 2000

[54] MECHANIZED SCAFFOLD

[76] Inventor: James M. Riegel, R.R. 2 P.O. Box 42, Linn, Mo. 65051

[21] Appl. No.: 09/220,936

[22] Filed: Dec. 24, 1998

[51] Int. Cl.[7] ..... E04G 3/16

[52] U.S. Cl. ..... 182/16; 182/12

[58] Field of Search ..... 182/16, 12, 13, 182/17; 414/508

[56] References Cited

U.S. PATENT DOCUMENTS

| | | | |
|---|---|---|---|
| 3,614,993 | 10/1971 | Penso | 182/16 |
| 3,817,346 | 6/1974 | Wehmeyer | 182/16 X |
| 3,865,203 | 2/1975 | Hibma | 182/16 X |
| 3,961,681 | 6/1976 | Fisher | 182/16 X |
| 4,475,611 | 10/1984 | Fisher | 182/13 X |
| 4,662,476 | 5/1987 | Ross | 182/16 X |
| 4,967,733 | 11/1990 | Rousseau | 182/16 X |
| 5,579,865 | 12/1996 | Butler et al. | 182/141 |
| 5,722,506 | 3/1998 | Takai | 182/16 |

*Primary Examiner*—Daniel P. Stodola
*Assistant Examiner*—Hugh B. Thompson

[57] ABSTRACT

A scaffold device including a frame having four stanchions, an upper peripheral railing mounted to tops of the stanchions, and a pair of cross brace assemblies mounted between the stanchions. A platform is also mounted between the stanchions. A plurality of drive units each include a housing with a wheel rotatably mounted therein with a motor operatively coupled thereto for rotating the wheels upon the actuation thereof. The housings are each rotatably mounted on a bottom end of one of the stanchions with an associated motor operatively coupled thereto for pivoting the housing and wheel upon the actuation thereof. Also included is a control assembly in communication with the motors for actuating the same.

9 Claims, 2 Drawing Sheets

MECHANIZED SCAFFOLD

BACKGROUND OF THE INVENTION

1. Field of the Invention

The present invention relates to scaffolds and more particularly pertains to a new mechanized scaffold for effectively and conveniently controlling movement of a scaffold.

2. Description of the Prior Art

The use of scaffolds is known in the prior art. More specifically, scaffolds heretofore devised and utilized are known to consist basically of familiar, expected and obvious structural configurations, notwithstanding the myriad of designs encompassed by the crowded prior art which have been developed for the fulfillment of countless objectives and requirements.

Known prior art scaffolds include U.S. Pat. Nos. 4,088,202; 5,381,872; U.S. Pat. No. Des. 274,945; U.S. Pat. Nos. 4,275,797; and 4,662,476.

In these respects, the mechanized scaffold according to the present invention substantially departs from the conventional concepts and designs of the prior art, and in so doing provides an apparatus primarily developed for the purpose of effectively and conveniently controlling movement of a scaffold.

SUMMARY OF THE INVENTION

In view of the foregoing disadvantages inherent in the known types of scaffolds now present in the prior art, the present invention provides a new mechanized scaffold construction wherein the same can be utilized for effectively and conveniently controlling movement of a scaffold.

The general purpose of the present invention, which will be described subsequently in greater detail, is to provide a new mechanized scaffold apparatus and method which has many of the advantages of the scaffolds mentioned heretofore and many novel features that result in a new mechanized scaffold which is not anticipated, rendered obvious, suggested, or even implied by any of the prior art scaffolds, either alone or in any combination thereof.

To attain this, the present invention generally comprises a frame having four stanchions. The frame further has an upper peripheral railing with a rectangular configuration defined by a pair of elongated side bars and a pair of short end bars. The upper peripheral railing is defined by four corners fixedly coupled to top ends of the stanchions. A pair of cross brace assemblies each include a pair of cross bars having bottom ends coupled to bottom ends of the stanchions. Such cross bars are further equipped with top ends mounted to the stanchions between a central extent and top ends thereof. As such, the cross bars of each cross brace assembly intersect and remain in a plane in which one of the elongated side bars of the peripheral railing resides. Also included is a plurality of vertically spaced horizontal end braces coupled between the stanchions in perpendicular relationship therewith. The end braces reside in a place in which one of the short end bars of the peripheral railing resides. A planar rectangular platform is mounted to the stanchions level with the top ends of the cross bars of the cross brace assemblies. FIG. 2 shows one of a plurality of drive units which each include a housing with a rectangular configuration. Such housing of each drive unit has a first end pivotally coupled to the bottom end of one of the stanchions of the frame such that the same resides within an interior space thereof. A disk-shaped wheel is mounted between tabs extending downwardly from side faces of the housing adjacent a second end thereof. In use, the wheel extends downwardly through a lower opening in the housing. Associated therewith is a drive motor mounted to a top face of the housing at the second end thereof. A rotor of such motor remains in abutment with a peripheral side of the disk-shaped wheel for rotating the same about an axis of rotation thereof upon actuation. The drive unit further includes a gear fixedly coupled on the bottom end of one of the stanchions and extends within the interior space of the housing. A turn motor is mounted within the housing at the first end thereof with a rotor in communication with the gear. In use, the turn motor serves for rotating the housing about an axis of the associated stanchion upon the actuation thereof. FIGS. 1 and 3 show a control power case having a rectangular configuration and mounted on a bottommost one of the end braces. Such control power case includes a battery positioned therein for powering purposes. A charger is positioned in the control power case and is connected to the battery with a plug for connecting with an alternating current source for receiving power therefrom. This power from the alternating current source is in turn transmitted to the battery for recharging purposes. Finally, the control power case includes a wheel controller connected between the motors and the battery for actuating the motors upon the receipt of activation signals. FIG. 1 shows a wheel control assembly including a post coupled to an end of the platform and extended upwardly therefrom. A steering wheel is mounted on the post about an axis which forms an acute angle with that of the post. Further, the steering wheel is connected to the wheel controller for transmitting the activation signals thereto. Finally, a toggle control assembly includes a panel mounted on the frame with a plurality of toggle switches mounted thereon. These toggle switches are preferably connected to the wheel controller for transmitting the activation signals thereto.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new mechanized scaffold apparatus and method which has many of the advantages of the scaffolds mentioned heretofore and many novel features that result in a new mechanized scaffold which is not anticipated, rendered obvious, suggested, or even implied by any of the prior art scaffolds, either alone or in any combination thereof.

It is another object of the present invention to provide a new mechanized scaffold which may be easily and efficiently manufactured and marketed.

It is a further object of the present invention to provide a new mechanized scaffold which is of a durable and reliable construction.

An even further object of the present invention is to provide a new mechanized scaffold which is susceptible of a low cost of manufacture with regard to both materials and labor, and which accordingly is then susceptible of low prices of sale to the consuming public, thereby making such mechanized scaffold economically available to the buying public.

Still yet another object of the present invention is to provide a new mechanized scaffold which provides in the apparatuses and methods of the prior art some of the advantages thereof, while simultaneously overcoming some of the disadvantages normally associated therewith.

Still another object of the present invention is to provide a new mechanized scaffold for effectively and conveniently controlling movement of a scaffold.

Even still another object of the present invention is to provide a new mechanized scaffold that includes a frame having four stanchions, an upper peripheral railing mounted to tops of the stanchions, and a pair of cross brace assemblies mounted between the stanchions. A platform in is also mounted between the stanchions. A plurality of drive units each include a housing with a wheel rotatably mounted therein with a motor operatively coupled thereto for rotating the wheels upon the actuation thereof. The housings are each rotatably mounted on a bottom end of one of the stanchions with an associated motor operatively coupled thereto for pivoting the housing and wheel upon the actuation thereof. Also included is a control assembly in communication with the motors for actuating the same.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
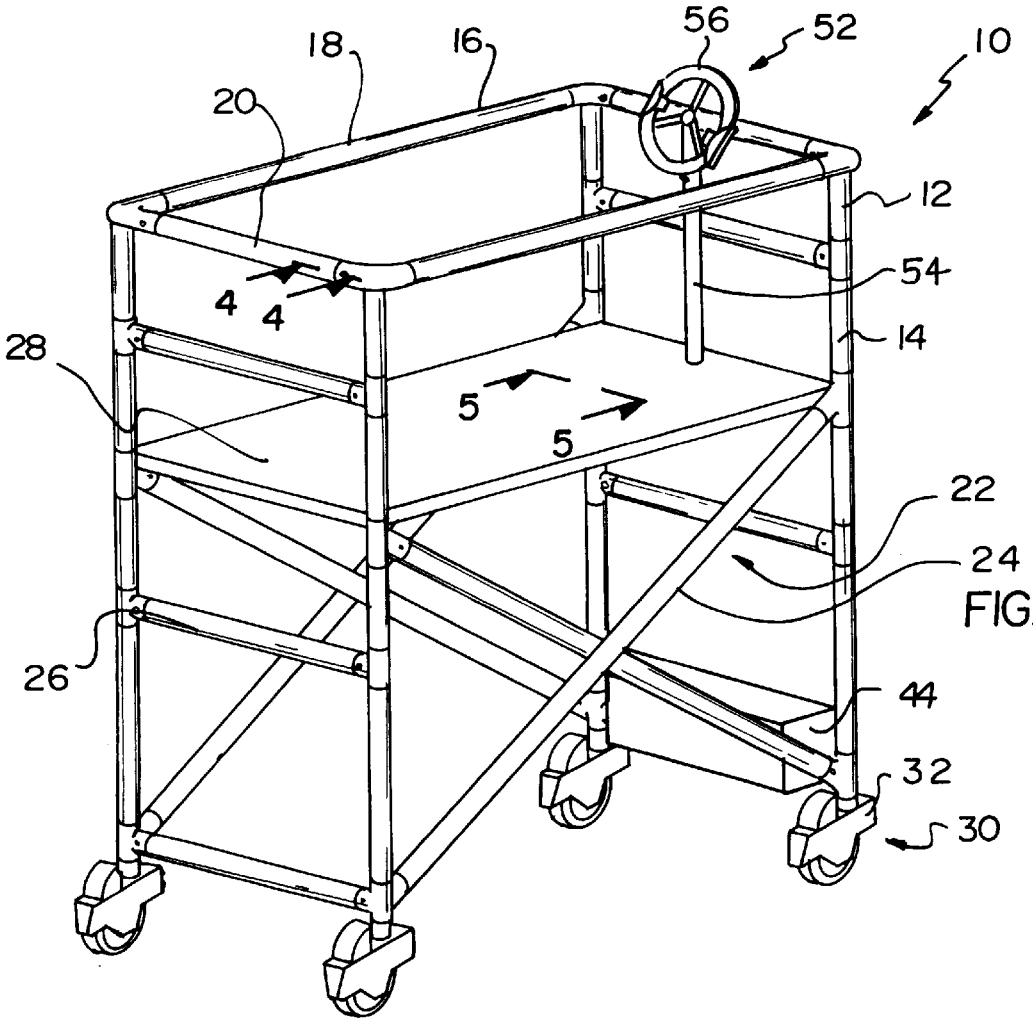
FIG. 1 is a perspective view of a new mechanized scaffold according to the present invention.

With reference now to the drawings, and in particular to FIGS. 1 through 5 thereof, a new mechanized scaffold embodying the principles and concepts of the present invention and generally designated by the reference numeral 10 will be described.

The present invention, designated as numeral 10, includes a frame 12 having four stanchions 14. The frame further has an upper peripheral railing 16 with a rectangular configuration defined by a pair of elongated side bars 18 and a pair of short end bars 20. The upper peripheral railing is defined by four corners fixedly coupled to top ends of the stanchions. Ideally, the side bars of the peripheral railing each have a length about equal that of the stanchions.

A pair of cross brace assemblies 22 each include a pair of cross bars 24 having bottom ends coupled to bottom ends of the stanchions. Such cross bars are further equipped with top ends mounted to the stanchions intermediate a central extent and the top ends of the stanchions. As such, the cross bars of each cross brace assembly intersect and remain in a plane in which one of the elongated side bars of the peripheral railing resides.

Also included is a plurality of vertically spaced horizontal end braces 26 coupled between the stanchions in perpendicular relationship therewith. The end braces reside in a place in which one of the short end bars of the peripheral railing resides. Ideally, each end of the scaffold device has three end braces including a bottommost end brace at the bottom ends of the stanchions and a pair of intermediate end braces each positioned a distance equal to about ⅓ and ⅔ a length of the stanchions from bottom ends of the stanchions, respectively. A planar rectangular platform 28 is mounted to the stanchions level with the top ends of the cross bars of the cross brace assemblies. Ideally, the various components of the frame of the scaffold device may be assembled and disassembled using male and female adapters. It should be noted that any other mobile unit may be used with the present invention.

Figure 2:
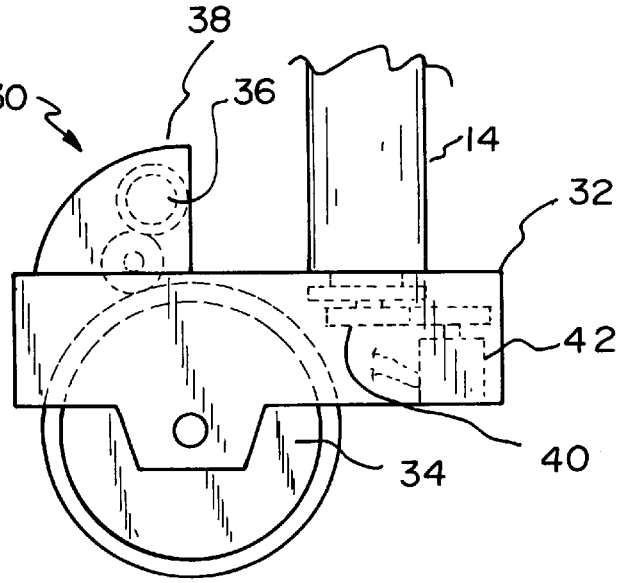
FIG. 2 is a side view of one of the drive units of the present invention.

FIG. 2 shows one of a plurality of drive units 30 which each include a housing 32 with a rectangular configuration. Such housing of each drive unit has a first end pivotally coupled to the bottom end of one of the stanchions of the frame such that the same resides within an interior space thereof. A disk-shaped wheel 34 is rotatably mounted between tabs extending downwardly from side faces of the housing adjacent a second end thereof. In use, the wheel extends downwardly through a lower opening in the housing. Associated therewith is a drive motor 36 mounted to a top face of the housing at the second end thereof. A rotor of such motor remains in abutment with a peripheral side of the disk-shaped wheel for rotating the same about an axis of rotation upon actuation. Ideally, the drive motor is covered by a quarter-disk shaped unit 38 positioned on the top face of the housing, as shown in FIG. 2. As an option, a roller may be positioned between the rotor of the drive motor for gearing down the rotation of the disk-shaped wheel.

The drive unit further includes a gear 40 fixedly coupled on the bottom end of the corresponding stanchion and extends within the interior space of the housing. A turn motor 42 is mounted within the housing at the first end thereof with a rotor in communication with the gear. In use, the turn motor serves for rotating the housing about an axis of the associated stanchion upon the actuation thereof. It should be understood that the term motor within the context of the present description may refer to any pneumatic, hydraulic, or mechanical means for producing motion with stored energy. As an option, each wheel may include a braking mechanism which works under the control of any desired control means.

Figure 3:
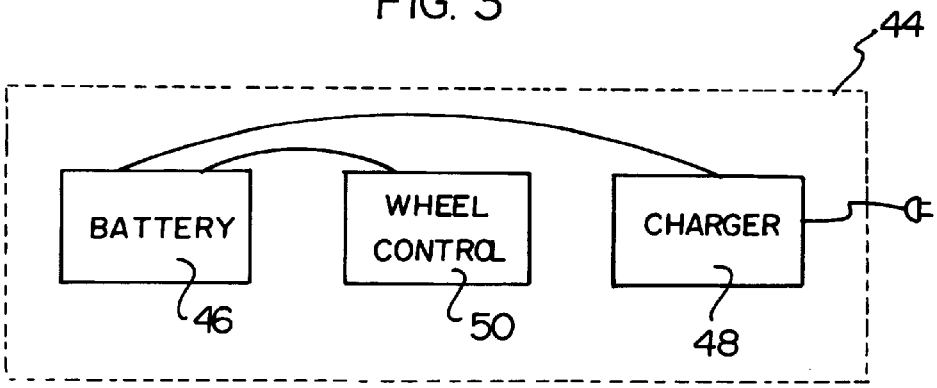
FIG. 3 is a schematic diagram of the control power case of the present invention.
Figure 4:
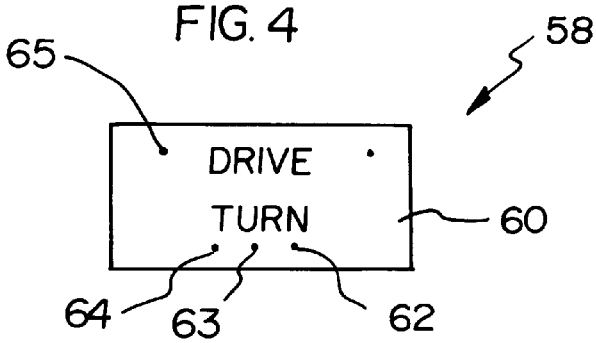
FIG. 4 is a top view of the toggle control assembly of the present invention.

FIGS. 1 and 3 show a control power case 44 having a rectangular configuration and mounted on a bottommost one of the end braces. Such control power case includes a battery 46 positioned therein for powering purposes. A charger 48 is positioned in the control power case and is connected to the battery with a plug for connecting with an alternating current source to receive power therefrom. This power from the alternating current source is in turn transmitted to the battery for recharging purposes. Finally, the control power case includes a wheel controller 50 connected between the motors and the battery for actuating the motors upon the receipt of activation signals.

FIG. 1 shows a wheel control assembly 52 including a post 54 coupled to an end of the platform and extended upwardly therefrom. A steering wheel 56 is mounted on the post about an axis which forms an acute angle with that of the post. Further, the steering wheel is connected to the wheel controller for transmitting the activation signals thereto.

Finally, a toggle control assembly 58 includes a panel 60 mounted on the frame or platform with a plurality of toggle switches 62 situated thereon. These toggle switches are preferably connected to the wheel controller for transmitting the activation signals thereto. It should be understood that the aforementioned control assemblies may be used in combination with each other or by themselves. As an option, the interconnection between the various components may be either wireless using transceivers, sensors, or a hard wire connector. Such transceivers or sensors are positioned adjacent to the toggle switches and may be used in combination with a base station computer unit which allows a user to predetermine a path over which the scaffold is to be maneuvered in an automatic manner. The transceivers or sensors preferably include a track sensor 63, a proximity sensor 64, and a level sensor 65.

In use, the activation signals generated by the control assemblies represent various movements of the toggle switches or steering wheel which in turn actuate the appropriate motors to afford mobility. For example, the toggle switches may include a right/left toggle switch, a forward/reverse toggle switch, and a brake toggle switch.

Figure 5:
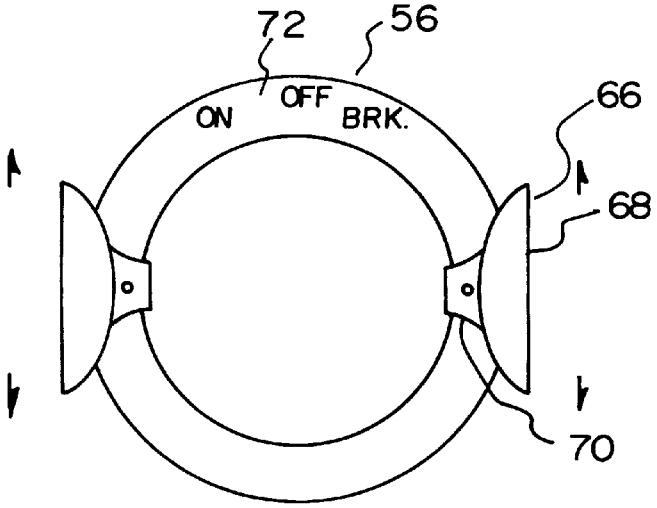
FIG. 5 is a close up view of the steering wheel of the steering wheel control assembly of the present invention.

Further, while the steering wheel may rotate conventional, it may also be equipped with a pair of levers 66 each having a semicircular outboard portion 68 and a linear portion 70 which is pivotally mounted on an annular mount 72, as shown in FIG. 5. Such levers each may be adapted to transmit activation signals to the drive units of the corresponding side of the frame. In use, the levers work similar to a modified joystick. In a forward biased orientation, the levers actuate the associated drive motors in a forward direction and further actuate the associated turn motors of the corresponding drive units such that the same remain straight. In a rear biased orientation, the levers actuate the associated drive motors in a forward direction and further actuate the associated turn motors of the corresponding drive units such that the same turn outwardly. In a rest position, the levers may control the drive units such that the same coast or brake accordingly.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A scaffold device comprising, in combination:

a frame including four stanchions, an upper peripheral railing with a rectangular configuration defined by a pair of elongated side bars and a pair of short end bars defining four corners fixedly Coupled to top ends of the stanchions, a pair of cross brace assemblies each including a pair of cross bars having bottom ends coupled to bottom ends of the stanchions and top ends mounted to the stanchions between a central extent thereof and top ends thereof such that the cross bars of each cross brace assembly intersect and remain in a plane in which one of the elongated side bars of the peripheral railing resides, a plurality of vertically spaced horizontal end braces coupled between the stanchions in perpendicular relatioaship therewith and residing in a place in which one of the short end bars of the peripheral railing resides, and a planar rectangular platform mounted to the stanchions level with the top ends of the cross bars of the cross brace assemblies;

a plurality of drive units each includling a housing with a rectangular configuration having a first end pivotally coupled to the bottom end of one of the stanchions of the frame such that the same resides within an interior space thereof, a disk-shaped wheel rotatably mounted between tabs extending downwardly front side faces of the housing adjacent a second end thereof wherein the wheel extends downwardly through a lower opening in the housing, a drive motor mounted to a top face of the housing at the second end thereof with a first rotor in abutment with a peripheral side of the disk-shaped wheel for rotating the same about an axis of rotation thereof upon actuation, a gear fixedly couple on the bottom end of one of the stanchions and extending within the interior space of the housing, a turn motor mounted within the housing at the first end thereof with a second rotor in communication with the gear for rotating the housing about an axis of the associated stanchion upon the actuation thereof;

a control power case having a rectangular configuration and mounted on a bottommost one of the end braces and including a battery positioned therein for powering purposes, a charger positioned therein and connected to the battery with a plug for connecting with an alternating current source for receiving power therefrom and transmitting the same to the battery for recharging purposes, and a wheel controller connected between the drive motor, the turn motor and the battery for actuating the motors upon the receipt of activation signals;

a wheel control assembly including a post coupled to an end of the platform and extending upwardly therefrom and a steering wheel mounted on the post and connected to the wheel controller for transmitting the activation signals thereto, wherein the steering wheel coupled to a top portion of the frame, the wheel control assembly further comprising a pair of levers being pivotally coupled to the steering wheel, each of the levers having a semi-circular outboard portion and a linear portion, each of levers being for transmitting activation signals to the drive units of a corresponding side of the frame; and a toggle control assembly including a panel mounted on the frame with a plurality of toggle switches and adjacent sensors mounted thereon and connected to the wheel controller for transmitting the activation signals thereto.

2. A scaffold device comprising:

a frame including four stanchions, a pair of cross brace assemblies mounted between the stanchions, and a platform mounted between the stanchions;

a plurality of drive units each including a housing with a wheel rotatably mounted therein and a motor operatively coupled thereto for rotating the wheels upon the actuation thereof, wherein the housings are each rotatably mounted on a bottom end of one of the stanchions of the frame with an associated motor operatively coupled thereto for pivoting the housing and wheel about a vertical axis upon the actuation thereof; and a control assembly in communication with the motors for actuating the same;

wherein the control assembly further comprises a steering wheel coupled to a top portion of the frame, a pair of levers being pivotally coupled to the steering wheel, each of the levers having a semi-circular outboard portion and a linear portion, each of levers being for transmitting activation signals to the drive units of a corresponding side of the frame.

3. A scaffold device as set forth in claim 2 wherein the control assembly includes a steering wheel mounted on a post which is in turn coupled to the platform adjacent to an end thereof.

4. A scaffold device as set forth in claim 2 wherein the control assembly includes a panel with a plurality of toggle switches and adjacent sensors mounted thereon.

5. A scaffold device as set forth in claim 2 wherein a plurality of end braces are mounted between the stanchions in perpendicular relationship with planes in which the cross brace assemblies are formed.

6. A scaffold device as set forth in claim 5 wherein a battery is mounted to a bottommost one of the end braces for powering purposes.

7. A mobile unit comprising:

a frame;

a plurality of drive units each including a housing with a wheel rotabably mounted therein and a motor operatively coupled thereto for rotating the wheels upon the actuation thereof, wherein the housings are each rotably mounted on a bottom of the frame with an associated motor operatively coupled thereto for pivoting the housing and wheel about a vertical axis upon the actuation thereof; and a control assembly in communication with the motors for actuating the same;

wherein the control assembly further comprises a steering wheel coupled to a top portion of the frame, a pair of levers being pivotally coupled to the steering wheel, each of the levers having a semi-circular outboard portion and a linear portion, each of levers being for transmitting activation signals to the drive units of a corresponding side of the frame.

8. A mobile unit as set forth in claim 7 wherein the control assembly includes a plurality of sensors for allowing the actuation of the motors by remote control.

9. A mobile unit as set forth in claim 7 wherein the control assembly includes a mapping device for actuating the motors such that the frame is moved along a predetermined path.

* * * * *